US008863972B2

(12) United States Patent
Schütz

(10) Patent No.: US 8,863,972 B2
(45) Date of Patent: Oct. 21, 2014

(54) TRANSPORT AND STORAGE CONTAINER FOR LIQUIDS

(75) Inventor: Udo Schütz, Selters/Westerwald (DE)

(73) Assignee: Protechna S.A., Fribourg (CH)

( * ) Notice: Subject to any disclaimer, the term of this patent is extended or adjusted under 35 U.S.C. 154(b) by 781 days.

(21) Appl. No.: 12/380,281

(22) Filed: Feb. 25, 2009

(65) Prior Publication Data

US 2009/0212048 A1 Aug. 27, 2009

(30) Foreign Application Priority Data

Feb. 27, 2008 (DE) ..... 10 2008 011 422
Jun. 7, 2008 (DE) ..... 10 2008 027 337

(51) Int. Cl.
*B65D 19/00* (2006.01)
*B65D 77/04* (2006.01)

(52) U.S. Cl.
CPC ..... *B65D 77/0466* (2013.01)
USPC ..... 220/23.91; 220/23.87; 220/485; 220/524.5; 220/9.4; 206/386

(58) Field of Classification Search
USPC ..... 220/562, 1.5, 4.12, 23.91
See application file for complete search history.

(56) References Cited

U.S. PATENT DOCUMENTS 4,676,373 A 6/1987 Schneider
5,253,777 A 10/1993 Schütz
6,202,844 B1 * 3/2001 Sedlmayr ..... 206/386
6,832,693 B2 * 12/2004 Schutz ..... 220/495.01
2002/0104465 A1 8/2002 Ohanesian
2003/0015529 A1 * 1/2003 Przytulla ..... 220/23.91
2005/0115473 A1 6/2005 Schütz
2009/0000525 A1 * 1/2009 Schmidt et al. ..... 108/57.3

FOREIGN PATENT DOCUMENTS

EP 0 509 228 A3 5/1994

* cited by examiner

*Primary Examiner* — Anthony Stashick
*Assistant Examiner* — Raven Collins
(74) *Attorney, Agent, or Firm* — McGlew and Tuttle, P.C.

(57) ABSTRACT

A transport and storage container for liquids includes an inner container of plastic material, an outer casing of a metal mesh or sheet metal, and a pallet-like underframe. The container is configured for manipulation by a transport means. A bottom of sheet metal rests on corner and middle legs for supporting the inner container equipped with a closable filling socket and a drain socket for connection to a removal fitting, wherein the inner container has a drain bottom with a middle draining groove which extends with a slight downward inclination from the rear wall of the container to the drain socket arranged at the end wall of the container for connection of the removal fitting. The bottom of the underframe adapted to the bottom of the inner container is divided into two bottom sections which are inclined downwardly from the two longitudinal rims of the bottom in the direction toward the middle axis of the bottom and from the rear rim toward the front rim of the bottom, and wherein the two bottom portions are equipped with stiffening corrugations having corrugation troughs located in a common horizontal plane.

6 Claims, 6 Drawing Sheets

TRANSPORT AND STORAGE CONTAINER FOR LIQUIDS

BACKGROUND OF THE INVENTION

1. Field of the Invention

The present invention relates to a transport and storage container for liquids. The container includes an inner container of plastic material, an outer casing of a metal mesh or sheet metal, and a pallet-like underframe. The container is configured for manipulation by means of a lifting device, shelf operating system or similar transport means. The container further includes a bottom of sheet metal resting on corner and middle legs for supporting the inner container equipped with a closable filling socket and a drain socket for connection to a removal fitting, wherein the inner container has a drain bottom with a middle draining groove which extends with a slight downward inclination from the rear wall of the container to the drain socket arranged at the end wall of the container for connection of the removal fitting, wherein the bottom of the underframe adapted to the bottom of the inner container is divided into two bottom sections which are inclined downwardly from the two longitudinal rims of the bottom in the direction toward the middle axis of the bottom and from the rear rim toward the front rim of the bottom, and wherein the two bottom portions are equipped with stiffening corrugations whose corrugation bottoms are located in a common horizontal plane.

2. Description of the Related Art

Standardized transport and storage containers of the above described type which are available on the market have a nominal volume of 640, 820, 1000, and 1250 liters.

SUMMARY OF THE INVENTION

It is the primary object of the present invention to improve the construction of the transport and storage container of the type described above with a view to enlarging the nominal volume without changing the outer dimensions of the container and a stiffening of the bottom of the underframe.

In accordance with the present invention, the angle of inclination of the two bottom sections of the bottom of the underframe having a slight downward inclination toward the bottom rim is in a range of 0 to 2° and the angle of inclination of the two bottom portions of the bottom of the underframe extending from the two lateral bottom rims toward the middle axis of the bottom is 1 to 3°.

The transport and storage container for liquids according to the present invention has the following advantages:

The enlargement of the nominal volume of the novel container manufactured with different volumes with the outer dimensions being unchanged, compared to the standard containers offered on the market, is achieved by lowering and flattening the bottom of the pallet-like underframe serving for supporting the inner container of plastic material, without impairing the clearance of the bottom of the support bottom of the underframe required for the manipulation of the transport and storage container by means of a transport device. As a result of the novel configuration of the support bottom of the underframe of the transport and storage container, a volume increase of up to 10 liters is achieved depending on the increased compared to the known standard containers. Moreover, the stability of the support bottom is increased as a result of the new shape, so that the material thickness of the sheet metal for manufacturing the support bottom can be reduced and the manufacturing cost can be lowered as a result. Finally, the underframe bottom has an optimum shape with respect to drawing technology, so that it is possible to use manufacturing materials for the underframe bottom which are less expensive than those of conventional transport and storage containers.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE INVENTION

Figure 1:
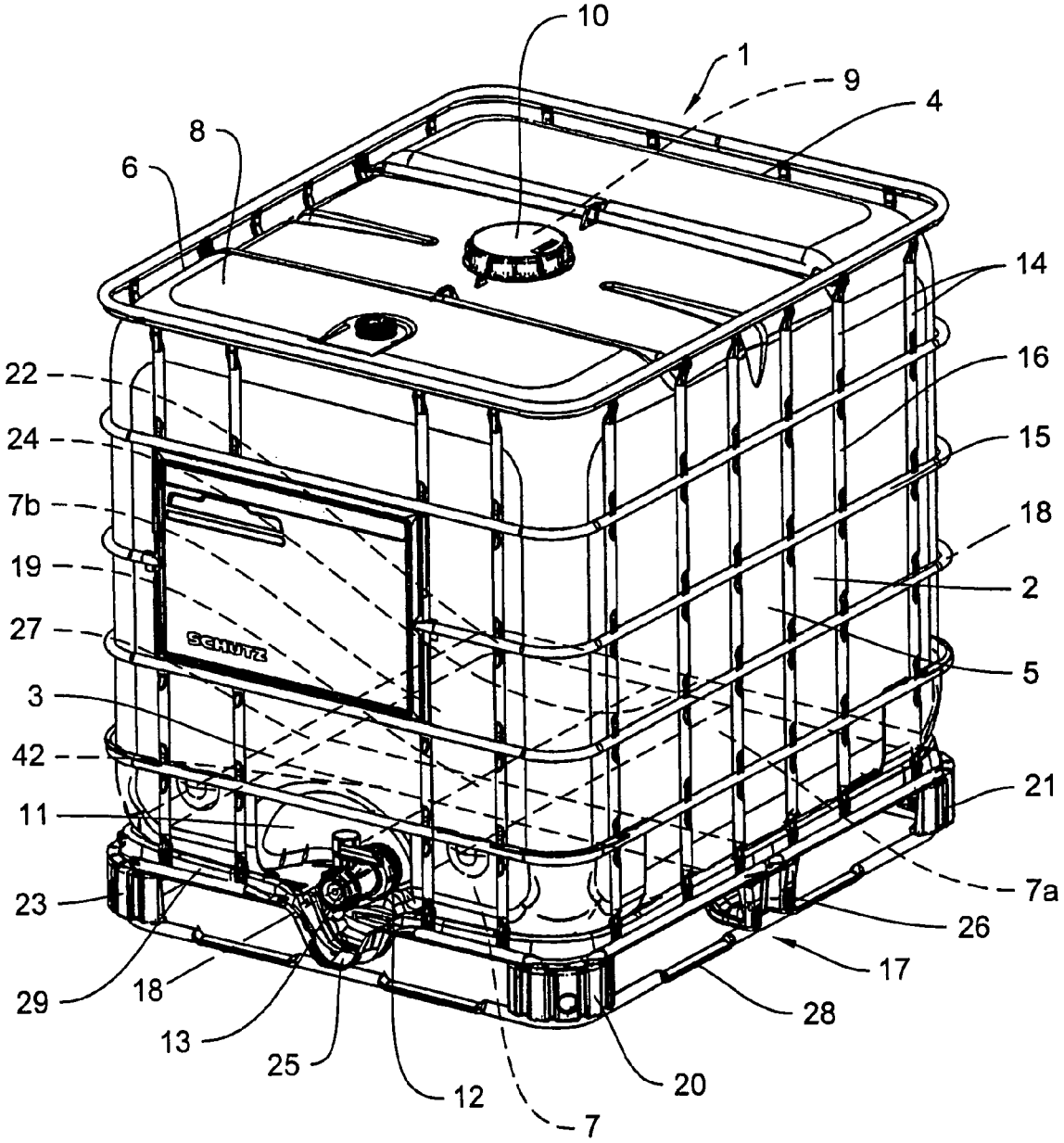
FIG. 1 is a perspective illustration of the transport and storage container.

The transport and storage container 1 according to FIG. 1 and constructed as a single-use or multiple-use container as shown in FIG. 1 has as its principal components an exchangeable parallelepiped-shaped inner container 2 of plastic material with a front wall 3, a rear wall 4 and two side walls 5, 6, lower and upper bottoms 7, 8, a filling socket 9 integrally formed at the upper bottom 8 and closable by means of a cover 10, and a drain socket 12 connected to a removal fitting 13, wherein the drain socket 12 is integrally formed to an indentation in the lower section of the front end wall 3 for connection of a removal fitting 13. The container also includes an outer casing 14 constructed as a grate jacket with intersecting horizontal and vertical grate rods 15, 16 of metal for receiving the inner container 2, and a pallet-like underframe assembly 17 with isonormally correct length and width dimensions.

The lower bottom 7 of the inner container 2 constructed as a discharge bottom is divided into two bottom sections 7*a*, 7*b* arranged symmetrically relative to the bottom middle axis 18-18 which extend with a flat inclination angle $\alpha$ in a range of 0 to 2° from the rear wall 4 toward the front end wall 3 of the container 2 and from the two side walls 5, 6 of the container at a flat angle of inclination $\beta$in a range of 1 to 3° relative to the middle axis of the bottom 18-18.

The bottom 7 of the inner container 2 has a central flat discharge groove 19 which extends with a slight inclination from the rear wall 4 of the container to the drain socket 12 arranged at the end wall 3 of the container for connecting the removal fitting 13.

Figure 2:
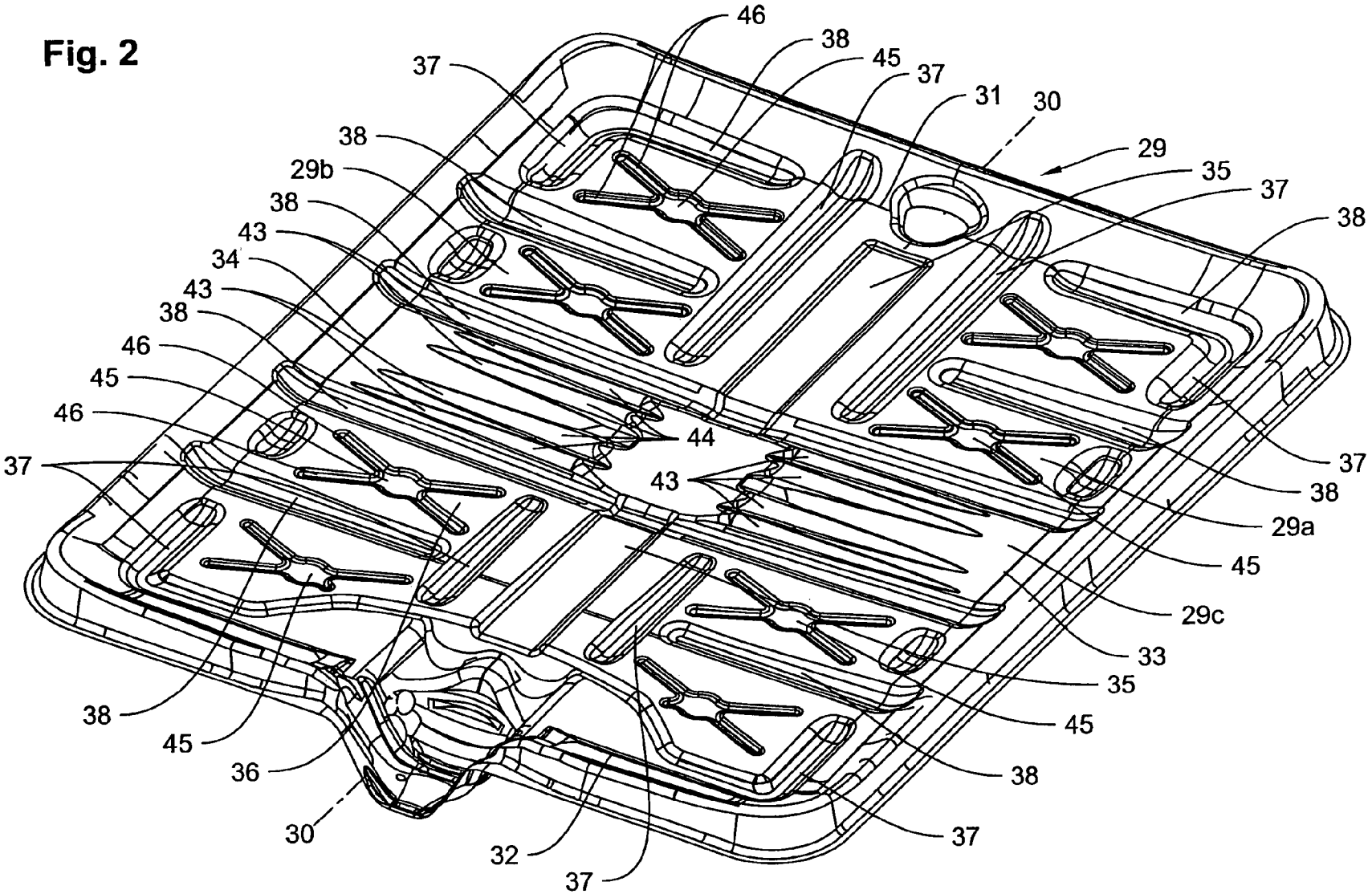
FIG. 2 is a perspective view, on a larger scale, of the bottom of the underframe for supporting the inner container of the transport and storage container.
Figure 3:
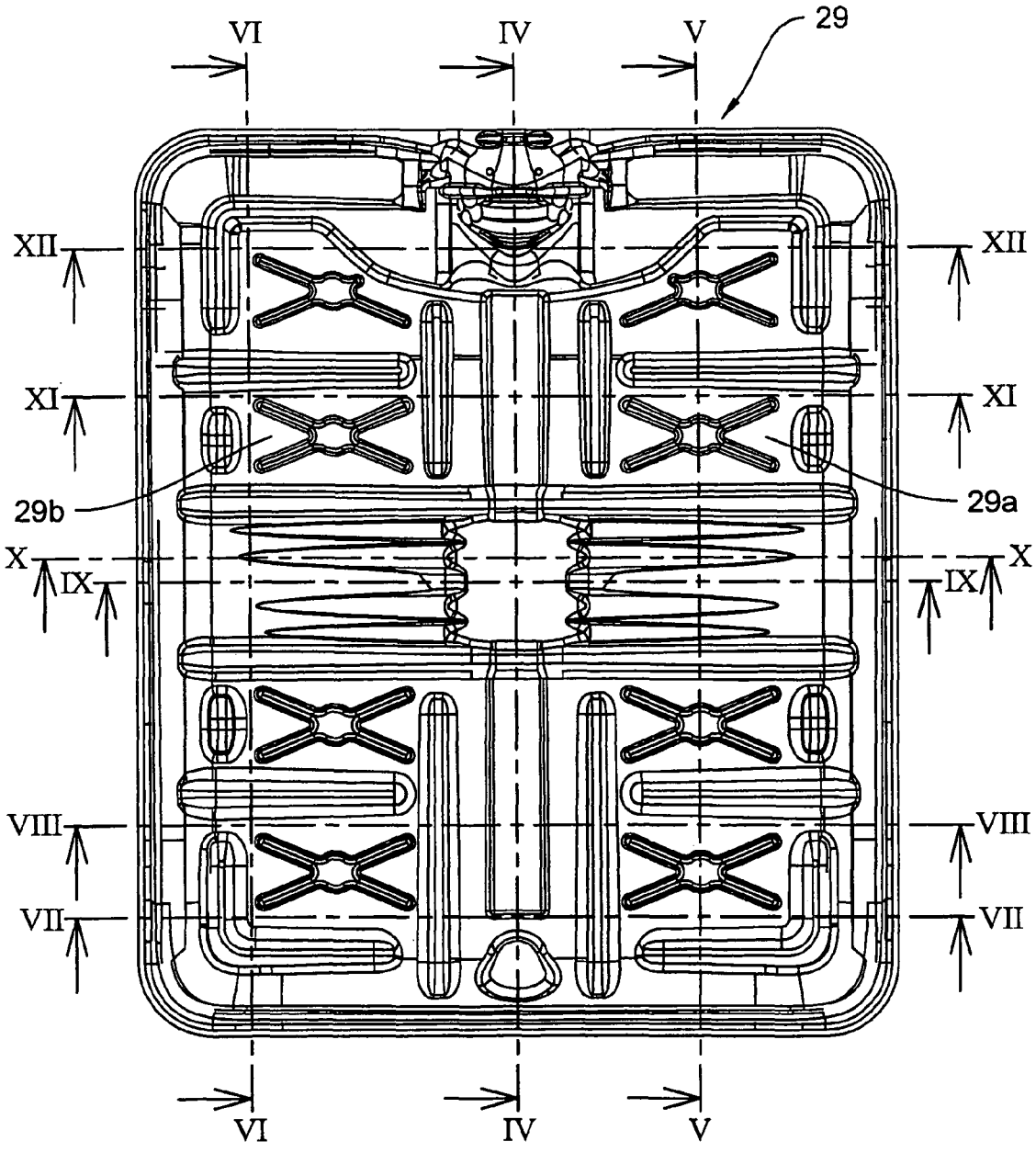
FIG. 3 is a top view of the underframe bottom of FIG. 2, shown on a larger scale.
Figure 4:
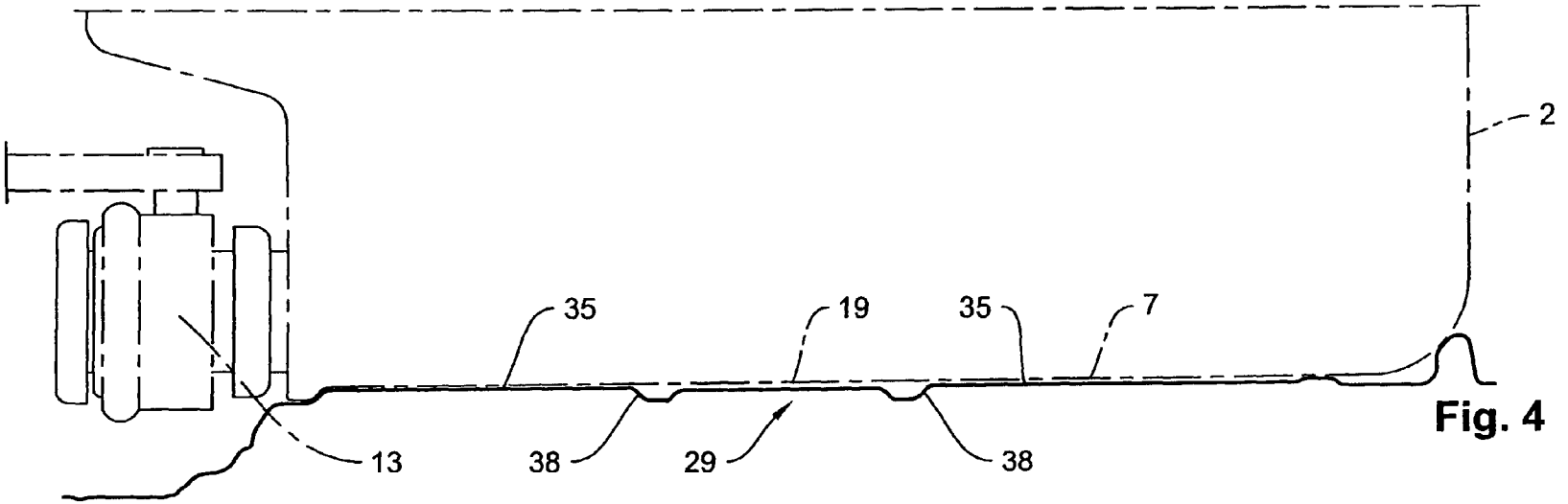
FIGS. 4 to 6 are simplified longitudinal sectional views of the underframe bottom taken along sectional lines IV-IV through VI-VI of FIG. 6.
Figure 5:
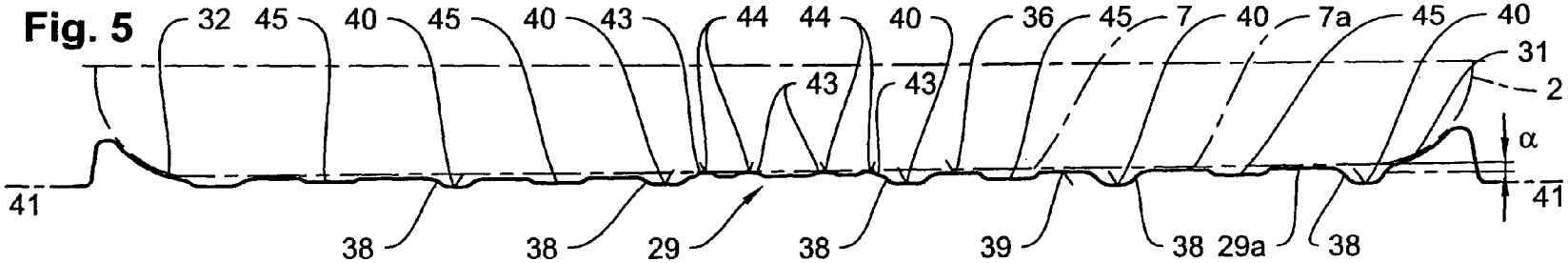
Figure 6:
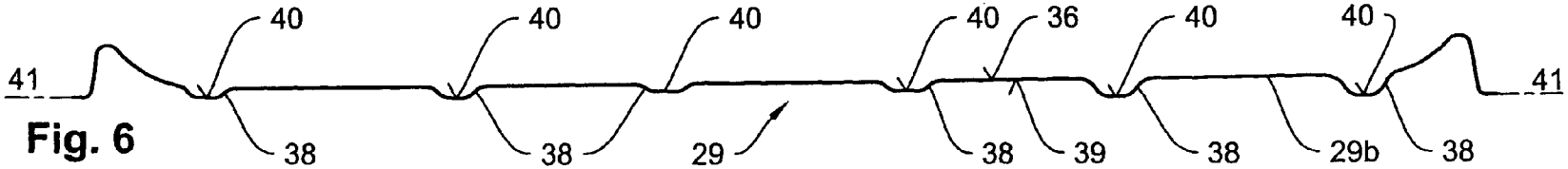
Figure 7:
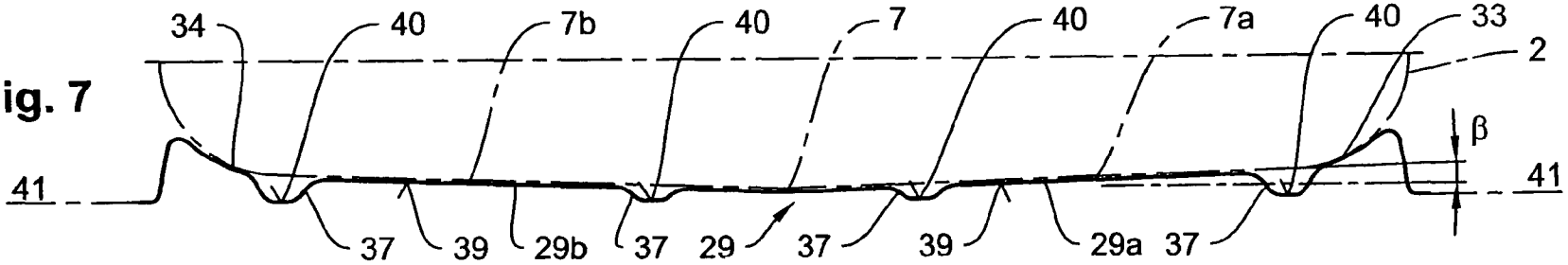
FIGS. 7 to 12 are simplified cross-sectional views of the underframe bottom taken along lines VII-VII to XII-XII of FIG. 3.
Figure 8:
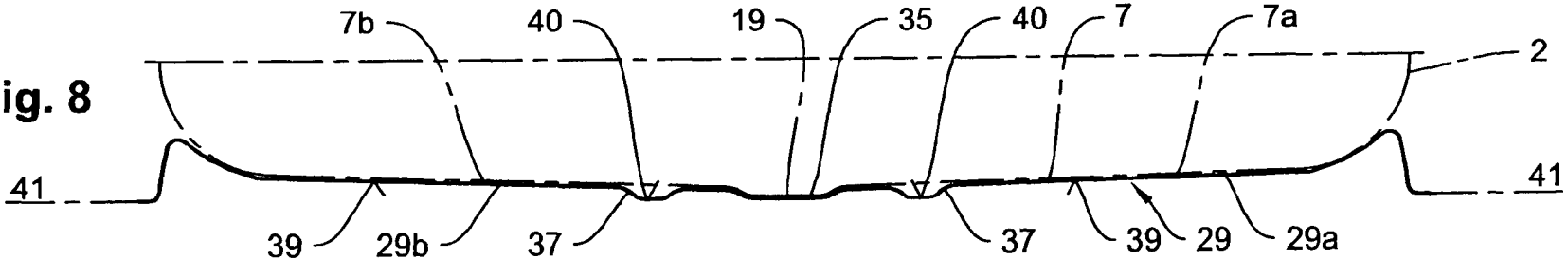
Figure 9:
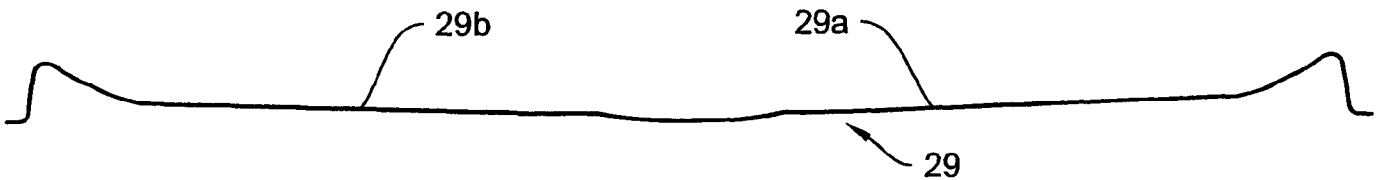
Figure 10:
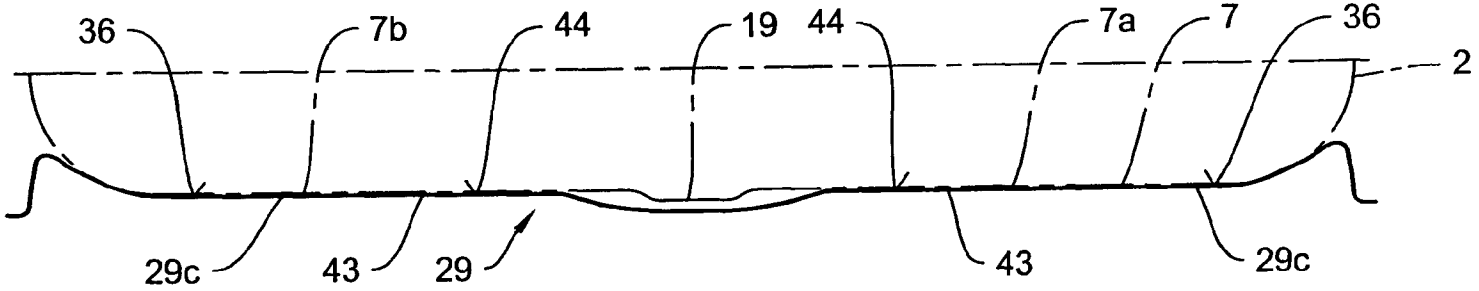
Figure 11:
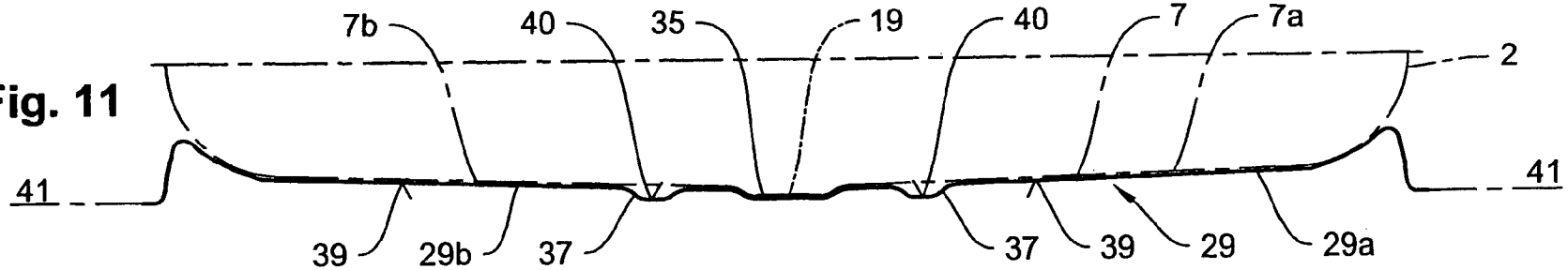
Figure 12:
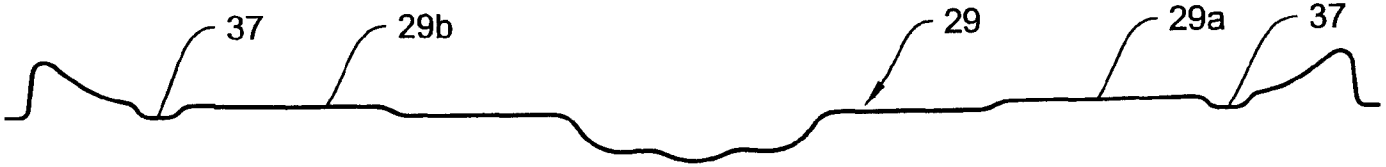

The underframe assembly 17 of the transport and storage container 1 according to FIGS. 2 and 3, which is equipped for manipulation by means of lifting devices, shelf operating devices, and similar transport means, has a bottom 29 placed on corner and middle legs 20-23, 24-27, respectively, and an underframe 28 on which rests the bottom 29 of sheet metal for supporting the inner container 2. The bottom 29 of the underframe assembly 17, adapted to the bottom 7 of the inner container 2, is divided into two bottom sections 29*a*, 29*b* arranged relative to the middle axis of the bottom 30-30. The two bottom sections 7*a*, 7*b* of the inner container 2 rest at a slight angle of inclination α of 0 to 2° on the two bottom sections 29*a*, 29*b* of the bottom 29, and under an angle of inclination α in the range of 0 to 2° from the rear rim 31 to the front bottom rim 32, and at an angle of inclination β in range of 1 to 3° from two lateral rims 33, 34 of the bottom 29 toward the middle axis 30-30 of the bottom 29.

Formed into the bottom 29 of the assembly underframe 17, adapted to the discharge bottom 7, of the inner container 2 is a flat groove-like indentation 35 for receiving the discharge groove 19 of the lower bottom 7 of the inner container 2, wherein the indentation is flat and extends downwardly from the rear toward the front.

Pressed into the upper side 36 of the two bottom sections 29*a*, 29*b* of the underframe 17 are stiffening corrugations 37, 38 extending in longitudinal and transverse direction of the bottom, wherein the corrugations protrude downwardly beyond the underside 39 of the bottom sections 29*a* and 29*b* and the troughs 40 of the corrugations are located in a common horizontal plane 41-41, so that the pallet-like underframe 17 of the transport and storage container 1 which rests with the bottom 29 horizontally and, thus, stable with respect to tilting, on the gripping arms of a fork lift, not shown, or of a shelf-operating device.

In the middle portion 29*c* of the two bottom sections 29*a*, 29*b* of the underframe bottom 29, to the underside 39 of which is fastened a traverse-like stiffening sheet 42 integrally connected to the lateral middle legs 26, 27, stiffening corrugations 43 are pressed into the bottom side 39 of the two bottom sections 29*a*, 29*b* which protrude upwardly beyond the upper side 36 of the two bottom portions 29*a*, 29*b* and extend in the transverse direction of the underframe bottom 29. The apexes 44 of the stiffening corrugations 43 serve for supporting the two bottom sections 7*a*, 7*b* of the lower bottom 7 of the inner container 2.

Pressed into the upper side 36 of the two bottom sections 29*a*, 29*b* of the underframe bottom 29 are cup-shaped indentations 45 for a further stiffening of the bottom, wherein the cup-shaped indentations protrude beyond the bottom underside 39 of the bottom sections 29*a*, 29*b* and additional stiffening corrugations 46 branch off from the bottom sections 29*a*, 29*b* and branch off in the manner of rays.

While specific embodiments of the invention have been shown and described in detail to illustrate the inventive principles, it will be understood that the invention may be embodied otherwise without departing from such principles.

The invention claimed is:

1. A transport and storage container for liquids, the container comprising an inner container of plastic material, an outer casing of a metal mesh or sheet metal, and a pallet-like underframe, wherein the container is configured for manipulation by means of a lifting device, shelf operating system or similar transport means, the container further comprising a bottom of sheet metal, resting on corner and middle legs, for supporting the inner container equipped with a closable filling socket and a drain socket for connection to a removal fitting, the bottom having two longitudinal rims, a rear rim and a front rim, wherein the inner container has a drain bottom with a middle draining groove which extends with a slight downward inclination from a rear wall of the container to the drain socket arranged at the end wall of the container for connection of the removal fitting, wherein the bottom of the underframe, adapted to the bottom of the inner container, is divided into two bottom sections, the two bottom sections having upper surfaces defining even planes which are inclined downwardly, with respect to horizontal, from the two longitudinal rims of the bottom in the direction toward the middle axis of the bottom and also inclined downwardly, with respect to horizontal, from the rear rim toward the front rim of the bottom, and wherein the two bottom sections are equipped with stiffening corrugations whose corrugation troughs are located in a common horizontal plane, wherein an angle of inclination of the two bottom sections of the bottom of the underframe has a slight downward inclination from the rear rim toward the bottom front rim in a range of 0 to 2° an angle of inclination of the two bottom sections of the bottom of the underframe extending from the two lateral bottom rims toward the middle axis of the bottom is 1 to 3°, the container further comprising cup-shaped indentations pressed into the upper side of the two bottom sections of the underframe bottom for stiffening the bottom, wherein the cup-shaped indentations protrude beyond the bottom side of the two bottom sections, and wherein additional stiffening corrugations extend from the indentations in the manner of rays.

2. A transport and storage container for liquids, the container comprising an inner container of plastic material, an outer casing of a metal mesh or sheet metal, and a pallet-like underframe, wherein the container is configured for manipulation by means of a lifting device, shelf operating system or similar transport means, the container further comprising a bottom of sheet metal, resting on corner and middle legs, for supporting the inner container equipped with a closable filling socket and a drain socket for connection to a removal fitting, wherein the inner container has a drain bottom with a middle draining groove which extends with a slight downward inclination from a rear wall of the container to the drain socket arranged at the end wall of the container for connection of the removal fitting, wherein the bottom of the underframe, adapted to the bottom of the inner container, is divided into two bottom sections which are inclined downwardly from the two longitudinal rims of the bottom in the direction toward the middle axis of the bottom and from the rear rim toward the front rim of the bottom, and wherein the two bottom sections are equipped with stiffening corrugations whose corrugation troughs are located in a common horizontal plane, wherein the angle of inclination of the two bottom sections of the bottom of the underframe has a slight downward inclination toward the bottom rim and is in a range of 0 to 2° and the angle of inclination of the two bottom sections of the bottom of the underframe extending from the two lateral bottom rims toward the middle axis of the bottom is 1 to 3° and comprising cup-shaped indentations pressed into the upper side of the two bottom sections of the underframe bottom for stiffening the bottom, wherein the cup-shaped indentations protrude beyond the bottom side of the two bottom sections, and wherein additional stiffening corrugations extend from the indentations in the manner of rays.

3. A transport and storage container for liquids and configured for manipulation by means of a lifting device, shelf operating system or similar transport means, the container comprising:

an inner container, the inner container having a drain bottom with a middle draining groove which extends with a downward inclination from a rear wall of the container to a front wall of the container and having a drain socket at the front wall for connection of a removal fitting;

an outer casing;

an underframe having corner and middle legs; and a bottom resting on the corner and middle legs, for supporting the inner container and adapted to the bottom of the inner container and comprising two longitudinal rims, a rear rim, a front rim and middle indentation for receiving the middle draining groove and comprising two bottom sections separated by the indentation, the two bottom sections each having an upper surface defining an even plane, which is inclined downwardly with both a side toward middle angle of inclination with respect to horizontal, from the respective longitudinal rim of the bottom in the direction toward the middle axis of the bottom and simultaneously also inclined downwardly with a rear toward front angle of inclination, with respect to horizontal, from the rear rim toward the front rim of the bottom, wherein the side toward middle angle of inclination is in a range of 1 to 3° and the rear toward front angle of inclination is in a range of 0 to 2° and wherein the two bottom sections each have stiffening corrugations with corrugation troughs located in a common horizontal plane.

4. The container according to claim 3, wherein the stiffening corrugations protrude downwardly beyond an underside of the bottom sections and extend in a longitudinal and transverse direction of the bottom.

5. The container according to claim 4, further comprising stiffening and support corrugations in the bottom of the inner container, wherein the corrugations are pressed into the bottom side of the two bottom sections, wherein the corrugations protrude upwardly beyond the upper side of the two bottom sections and extend in the transverse direction of the bottom beyond a traverse-like stiffening sheet mounted on an underside of the bottom.

6. The container according to claim 3, wherein the bottom further comprises cup-shaped indentations pressed into the upper side of the two bottom sections of the underframe bottom for stiffening the bottom, wherein the cup-shaped indentations protrude beyond the bottom side of the two bottom sections, and wherein additional stiffening corrugations extend from the indentations in the manner of rays.

* * * * *